US005217319A

United States Patent [19]

Klohn

[11] Patent Number: 5,217,319

[45] Date of Patent: Jun. 8, 1993

[54] METAL TACTILE EDGE-WARNING STRIP

[75] Inventor: Helmut H. Klohn, Brockton, Mass.

[73] Assignee: Advantage Metal Systems, Inc., Brockton, Mass.

[21] Appl. No.: 705,124

[22] Filed: May 24, 1991

[51] Int. Cl.[5] ..... E01F 11/00

[52] U.S. Cl. ..... 404/15; 434/113; 340/407

[58] Field of Search ..... 404/15; 340/407; 434/112, 113, 114; 116/205, 208, 209, DIG. 10, DIG. 16, DIG. 17

[56] References Cited

U.S. PATENT DOCUMENTS

| | | | |
|---|---|---|---|
| 1,696,510 | 12/1928 | Wallace | 404/15 |
| 1,698,594 | 1/1929 | Hoff | 414/15 |
| 1,932,206 | 10/1933 | Estes | 404/15 |
| 2,031,396 | 2/1936 | Voight | 404/15 |
| 4,127,346 | 11/1978 | Bouffard | 404/15 |
| 4,404,778 | 9/1983 | Ushimaru | 52/101 |
| 4,620,816 | 11/1986 | Kupfer | 434/112 |
| 4,715,743 | 12/1987 | Schmanski | 404/9 |
| 5,086,287 | 2/1992 | Nutzel | 434/112 |

FOREIGN PATENT DOCUMENTS

| | | | |
|---|---|---|---|
| 21483 | 10/1935 | Australia | 404/15 |
| 379690 | 8/1932 | United Kingdom . | |
| 452962 | 9/1936 | United Kingdom . | |
| 2166179 | 4/1986 | United Kingdom | 404/15 |

OTHER PUBLICATIONS

Tactile Edge Warning System Evaluation, Toronto Transit Commission, Sep. 18, 1990.

*Primary Examiner*—Thuy M. Bui
*Assistant Examiner*—Roger J. Schoeppel
*Attorney, Agent, or Firm*—Landiorio & Dingman

[57] ABSTRACT

A tactile edge-warning strip made from a sheet-metal strip having a series of projections formed in the strip to present an uneven surface for tactile feedback. The upper surface is covered with a roughened coating to inhibit slipping. The strip further includes an angled strip edge portion for anchoring the strip edge into the surface to which it is fixed to inhibit lifting of the strip from the surface.

19 Claims, 2 Drawing Sheets

METAL TACTILE EDGE-WARNING STRIP

FIELD OF INVENTION

This invention relates to metal tactile edge-warning strip particularly suited for application to train platform edges for providing a safe, effective means of warning visually-handicapped persons when approaching the platform edge.

BACKGROUND OF INVENTION

There are many instances in which visually handicapped persons need to be warned of their approach to a dangerous area. For example, it is critical in public areas to warn those persons of their proximity to uneven surface areas. Some examples of areas requiring such warning include train platform edges and sidewalk curbs, especially in the vicinity of cross-walks where the warning can also indicate the presence of a cross-walk.

There have been numerous attempts to provide such warning to visually handicapped persons. Most of those attempts employ tactile warning, often times along with some visual warning to which partially-sighted visually handicapped persons may be able to respond. Most of the tactile warning systems employ relatively small tiles having some type of uneven surface which the visually-handicapped person can detect with a cane or his or her feet. One such device is disclosed in U.S. Pat. No. 4,715,743. That device comprises tiles made of a flat plate of a flexible polymer material with a number of raised bumps formed of the same material and projecting from the surface. These tiles must be set in concrete or mortar in the areas in which warning is desired. In existing stations, concrete must be removed in order to create a setting bed for the tile and allow for a level installation. Accordingly, the tiles are difficult and expensive to install. Further, the area in which the tiles are installed may not be used by the public until the mortar is set, which can be a problem in areas such as train stations which are typically operated 24 hours a day.

Since these solutions require a large number of tiles, each having four edges, there are innumerable tile edges in any area of tiles, all of which need to be aligned to present a flat, even tile area which will not cause pedestrians to stumble or trip. In addition, any one of those tile edges may be caught and lifted partially or fully by pedestrian traffic, or more likely, by machinery used to clean the surface. Lifting is especially a problem in outdoor areas in the northern latitudes in which the surfaces must be cleared of snow during the winter; the snow clearing shovels or tractors can easily catch a tile edge and lift the tile, necessitating immediate replacement to prevent the creation of a dangerous hazard to both visually impaired and normally sighted individuals. Because tiles are not mechanically fastened, the expansion of materials due to changes in the weather causes the tiles to frequently delaminate from their bonding agents. In outdoor applications, the tiles tend to bleach rapidly, thereby losing some of their visual impact. Accordingly, the tile tactile edge-warning systems have a number of drawbacks which have prevented them from being ideal solutions to the problem.

SUMMARY OF INVENTION

It is therefore an object of this invention to provide a tactile edge-warning system which presents a uniform, durable surface which is both non-skid and readily detectable by a visually impaired person.

It is a further object of this invention to provide such a system in which the tactile edge-warning device is quickly and easily anchored to the surface requiring tactile warning.

It is a further object of this invention to provide such a system in which the tactile edge-warning device may not easily be lifted from the surface to which it is anchored.

It is a further object of this invention to provide such a system in which most edge warning applications can be accomplished with large, unitary structures which minimize the number of hazardous edge intersection areas.

It is a further object of this invention to provide a wear-resistant surface which can be easily seen and easily maintained.

This invention features a tactile edge-warning strip including a sheet-metal strip for fixing to a surface, a series of projections formed in the strip to present an uneven surface for tactile feedback, a roughened coating on the uneven surface to inhibit slipping, and an angled strip edge portion or return for anchoring the strip edge into the surface to inhibit strip lifting. Preferably, the strip is made of a pregalvanized steel or other material such as stainless steel or aluminum. Sixteen-gauge pregalvanized has been found to be an ideal material. The strip preferably includes a series of holes through the strip along its edges to allow passage of surface fasteners. The strip may include the angled edge portions on more than one edge to allow firm anchoring of the exposed edges of the strip to prevent its lifting and also provide a "cleaner" finish. Preferably, the strip edge is angled at approximately 90° to the strip and projects $\frac{1}{4}''$ to $\frac{1}{2}''$ below the strip.

The roughened surface coating may include an epoxy-based substance having therein a hard filler material for creating the roughened coating. The edges may be anchored into the surface by a polyurethane-based sealant.

The strip projections may include truncated, tapered bumps or elongated, linear bumps or other configurations. The projections in one embodiment are formed in a regular pattern. Alternatively, the projections may be spaced closer together toward one end of the strip than toward the opposite edge to provide tactile strip-position warning.

DISCLOSURE OF PREFERRED EMBODIMENT

Other objects, features and advantages will occur to those skilled in the art from the following description of a preferred embodiment and the accompanying drawings, in which.

Figure 1:
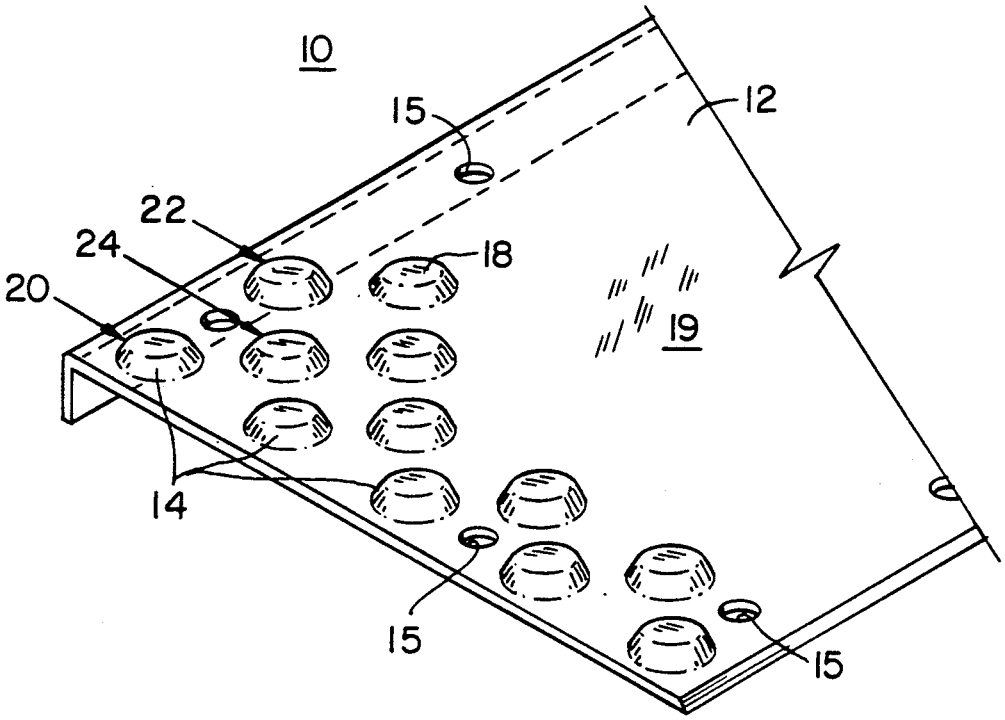
FIG. 1 is an axonometric view of a tactile edge-warning strip according to this invention.

There is shown in FIG. 1 tactile edge-warning strip 10 according to this invention. Strip 10 is made from a strip of sheet metal. Preferably, galvanized steel is employed; it has been found that 16 gauge pregalvanized steel accomplishes a strip which is stiff and tough, yet light enough to allow the installation of long strips by only one or two people. Aluminium or stainless steel may also be used. Strip 10 includes angled strip edge 16 which helps to anchor the strip as described below. The top surface of strip 10 includes a number of raised projections 14, only some of which are shown, to present an uneven surface for tactile feedback. Further included are a series of drilled holes 15 along all four edges of strip 10 to allow the strip to be anchored to surfaces requiring tactile warning. The strip may be anchored to wooden surfaces by screws, and to concrete and asphalt surfaces with specialized fastening devices known in the art.

Figure 2:
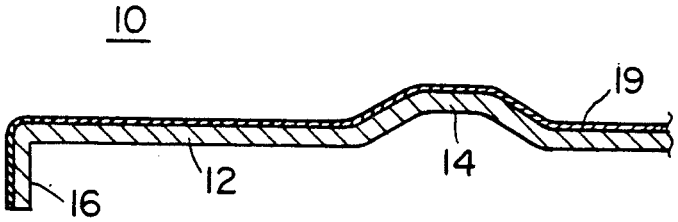
FIG. 2 is an end view of the strip of FIG. 1 detailing the raised projections and the angled strip edge.

Strip 10 is shown in end view in FIG. 2, in which it can be seen that angled strip edge 16 is preferably bent at a 90° angle to strip 12. The edge may extend ¼" to ½". The other edge may be beveled as shown to minimize sharp edges and reduce tripping hazard. Projections 14 are preferably formed by deforming the sheet metal strip material so that the entire strip can be made from a single piece of metal. This arrangement allows a tactile edge-warning strip according to this invention to be made of virtually any length and width to fit a desired application. For example, many train platforms require tactile warning of up to 36" width or ⅓ of a train platform width, whichever is smaller, along the length of the platform. This may be accomplished in the present invention by employing a 36.5" wide sheet metal strip which has projections 14 formed therein, and then one or more edges bent to create angled strip edge or edges such as edge 16. The only limitation to the size and shape of the strip is the ability to finish the strip and transport, carry and install the strip. Accordingly, many train platforms can be protected with one or only a few strips placed end to end. As a result, there are very few edges on the platform which are subject to lifting and the consequent presentation of an uneven surface which can cause stumbling or tripping, even of sighted persons.

The upper surface of strip 12 may be coated with a rough coating 19, FIG. 2, to inhibit slipping and aid in detection by the visually impaired. Preferably, the coating is an epoxy-based liquid material which hardens after application by painting or spraying, and which includes a relatively high solids content for providing a non-slip surface. The strip may need to be prepared by blasting and then priming. The material is preferably colored a bright color so that partially/fully-sighted persons may see the contrast and in this manner confirm the fact that they are on or approaching a tactile strip. One material which has been found suitable for coating 19 is EPOXO 500 Floor and Deck Coating made by Safety Technologies, Inc., Roseland, N.J.

A preferred embodiment of the shape and pattern of projections 14, FIGS. 1 and 2, shows that projections 14 are round tapered projections having a relatively flat top section 18. Preferably, projections 14 are formed in a number of rows 20, 22 and 24, with alternating rows, 20 and 22, identical, interspersed with row 24 of projections offset to create the regular offset pattern shown. Alternatively, the size, shape and/or spacing of the projections may be altered as desired. For example, the projections may be made closer together toward one edge of the strip to indicate that the strip edge is being approached. Such an embodiment may be useful in a train platform for warning the visually-handicapped person when the very edge of the platform is being approached. Alternatively, these projections, or projections of any other shape, such as elongated, linear projections, may be formed into patterns which indicate a direction or other state to the visually-handicapped person.

Figure 3A:
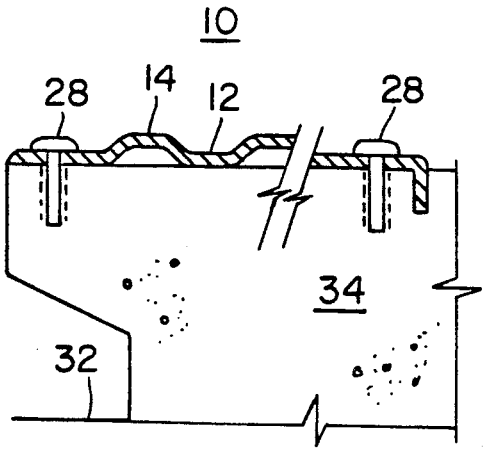
FIG. 3A is a cross sectional view of a tactile edge warning strip according to this invention anchored to a platform edge.
Figure 3B:
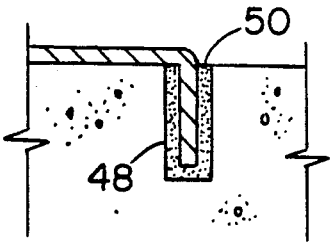
FIG. 3B is a detailed cross section of the strip edge of FIG. 3A embedded in the platform.

FIG. 3A illustrates the application of strip 10 to concrete train platform 34 leading to track bed 32. Strip 10 is held onto platform 34 by concrete nails such as Zamac-Nailin made by Rawl of New Rochelle, N.Y. If an aluminum tactile strip is used on concrete platform 34, a coat of bituminous paint may be applied in order to inhibit galvanic action. Platform 34 is prepared by making a saw cut 48 therein, FIG. 3B, for accepting angled edge portion 16 of strip 10 so that a raw edge of the strip is not presented on the platform surface to decrease any tripping hazard, and also to inhibit the lifting of the strip from the platform, especially by mechanical devices used for cleaning or shovelling the platform which can easily slide under an exposed edge and lift the tactile warning device. Saw cut 48 is filled with caulking 50 for anchoring edge 16 therein. Caulk 50 is preferably a polyurethane based adhesive such as Sikaflex-1A which firmly anchors, in conjunction with nails 28, strip 10 to platform 34. The other edges may also be caulked to eliminate penetration of water or other liquids. Other possible uses of the strip are for floor plates providing a non-skid surface to avoid removal of contaminated flooring, which cannot be painted directly with a non-skid paint, for example in diesel maintenance facilities. Also, the strip may be used as a threshold upon entering a train or transit vehicle in order to avoid slipping hazard.

Figure 4:
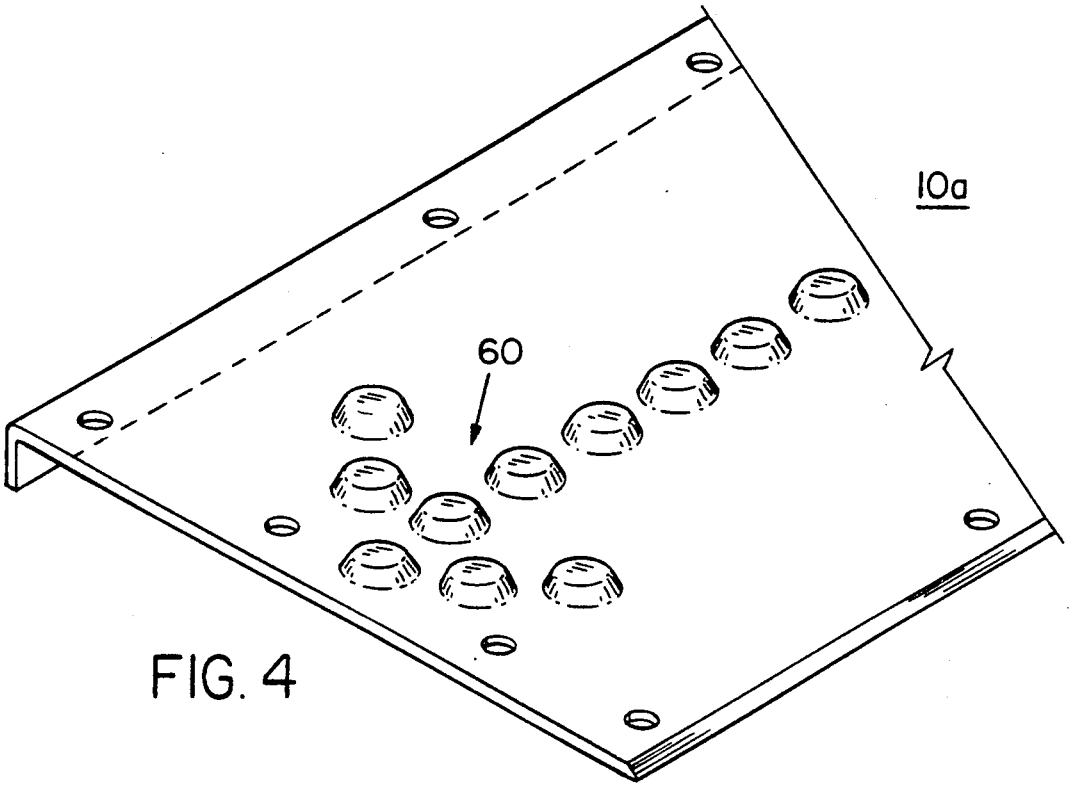
FIG. 4 is an axonometric view of an alternative dimple pattern.
Figure 5:
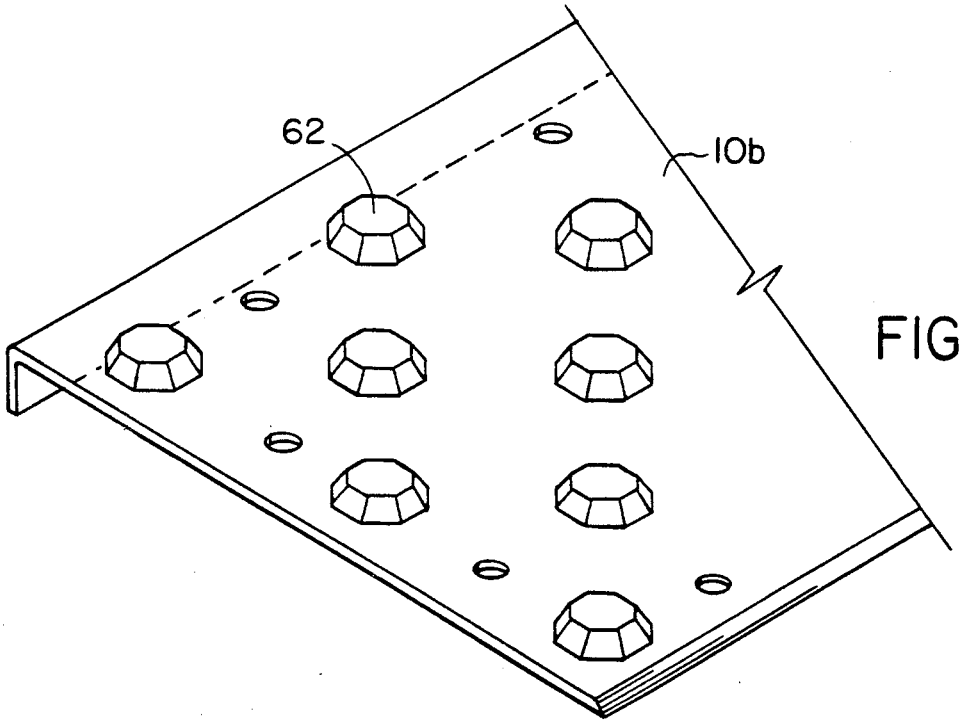
FIG. 5 is an axonometric view of an alternative dimple shape.
Figure 6:
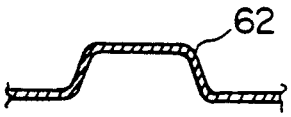
FIG. 6 is a cross-section through a dimple of FIG. 5.

FIG. 4 details pattern 60 of dimples on strip 10*a* that may be used as a guide. Other shapes of dimples may also be used, such as octagonal-sided dimples 62, FIGS. 5 and 6.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A tactile edge-warning strip, comprising:

an elongated steel-metal strip for fixing to a surface requiring human tactile feedback;

a series of projections formed in said strip to present an uneven surface for tactile feedback; and an angled strip edge portion substantially the length of the strip for anchoring said strip into the surface to inhibit strip lifting.

2. The tactile strip of claim 1 further including a series of holes through the strip along its edges to allow passage of surface fasteners.

3. The tactile strip of claim 1 in which said strip includes angled strip edge portions on at least two sides of the strip and substantially the lengths of said sides to firmly anchor said strip to the surface.

4. The tactile strip of claim 1 in which said strip edge is angled at approximately 90° to said strip.

5. The tactile strip of claim 4 in which said strip edge portions approximately ¼ to 178 below said strip.

6. The tactile strip of claim 1 in which said strip is made from aluminum.

7. The tactile strip of claim 1 in which said strip is made from stainless steel.

8. The tactile strip of claim 1 in which said projections includes truncated, tapered dimples.

9. The tactile strip of claim 1 in which said projections include elongated, linear dimples.

10. The tactile strip of claim 1 in which said projections are formed in a regular pattern.

11. The tactile strip of claim 1 in which said projections are spaced closer together toward one edge of said strip than toward the opposite edge to provide tactile strip-position warning.

12. The tactile strip of claim 1 further including means for anchoring said angled strip edge into the surface.

13. The tactile strip of claim 12 in which said means for anchoring includes a polyurethane-based sealant.

14. The tactile strip of claim 1 in which said strip is made from galvanized steel.

15. The tactile strip of claim 1 further including a roughened coating on said uneven surface to inhibit slipping.

16. The tactile strip of claim 15 in which said roughened coating includes an epoxy based substance.

17. The tactile strip of claim 16 in which said substance includes hard filler material for creating said roughened coating.

18. The tactile strip of claim 1 in which an edge of said strip is beveled to avoid sharp edges and reduce tripping hazard.

19. A tactile train platform edge-warning strip, comprising:

an elongated sheet-metal strip for fixing to a train platform edge;

a series of regularly-spaced projections formed in said strip to present an uneven surface for tactile feedback;

a high-solids colored epoxy coating on said uneven surface to inhibit slipping; and a ¼" to 178 " 90° angled strip edge portion substantially the length of the edge for anchoring the strip edge in the platform to inhibit strip lifting.

* * * * *